United States Patent [19]

Chrisley

[11] Patent Number: 4,550,465

[45] Date of Patent: Nov. 5, 1985

[54] APPARATUS FOR COLLECTING LITTER AND OBJECTS FROM A GROUND SURFACE

[76] Inventor: Barney D. Chrisley, 742 Peach St., Abilene, Tex. 79602

[21] Appl. No.: 473,088

[22] Filed: Mar. 8, 1983

[51] Int. Cl.[4] ..... E01H 1/00

[52] U.S. Cl. ..... 15/84; 56/328 R; 56/364; 171/63; 414/439

[58] Field of Search ..... 15/79 R, 79 A, 83–86, 15/340, 385; 56/328 R, 364; 414/437–441; 171/63

[56] References Cited

U.S. PATENT DOCUMENTS

| | | | |
|---|---|---|---|
| 2,514,945 | 7/1950 | Fortier . | |
| 2,916,753 | 12/1959 | Redpath et al. . | |
| 2,928,225 | 3/1960 | Spencer | 56/328 R |
| 3,112,593 | 12/1963 | Ronning . | |
| 3,475,889 | 11/1969 | Overstreet et al. . | |
| 3,623,306 | 11/1971 | Reynolds . | |
| 3,712,039 | 1/1973 | Avis . | |
| 3,746,099 | 7/1973 | Black . | |
| 3,849,824 | 11/1974 | Doering | 56/364 |
| 3,872,657 | 3/1975 | Ramacher et al. | 56/364 |
| 3,888,370 | 6/1975 | Gamblin . | |
| 3,911,519 | 10/1975 | Anlas et al. . | |
| 3,923,101 | 12/1975 | Donohue . | |
| 4,066,179 | 1/1978 | Livingston . | |
| 4,255,923 | 3/1981 | Spaida et al. | 56/364 |
| 4,419,784 | 12/1983 | Lex | 15/384 |

FOREIGN PATENT DOCUMENTS

| | | | |
|---|---|---|---|
| 437427 | 4/1912 | France | 15/83 |

*Primary Examiner*—Edward L. Roberts

*Attorney, Agent, or Firm*—Lowe, King, Price & Becker

[57] ABSTRACT

An apparatus for picking up surface litter on the ground includes a movable main frame towed by a lightweight vehicle. A roller carriage pivotally attached to the main frame supports identical front and rear oppositely rotating tandem rollers each having ground engaging rows of resilient fingers. The rollers are driven by a ground engaging drive wheel and sprocket gear arrangement. The resilient fingers spread apart to entrap litter and mesh between the rollers to transfer litter downstream, to a main frame conveyor for containment within a trash drum. A pair of wiper blades completely dislodge litter entrapped between the roller fingers and cooperate with upper portions of each roller to define a transfer path towards the conveyor. In a second embodiment, the trash drum is pivotally secured to the main frame to control the height of the drum discharge opening. In a third embodiment, a rectangular, box-like main frame is supported by a rear panel door of a dump truck. A roller carriage carrying tandem rollers is attached to the main frame to pivot between a horizontal, ground engaging position laterally adjacent the truck and a vertical storage position. Surface litter collected by the roller fingers is discharged into an auger conveyor attached to the carriage and laterally propelled into a hopper on the main frame. The hopper directs litter into a main frame conveyor for discharge into the dump truck.

28 Claims, 24 Drawing Figures

APPARATUS FOR COLLECTING LITTER AND OBJECTS FROM A GROUND SURFACE

TECHNICAL FIELD

This invention relates generally to apparatus for collecting objects from a surface and, more particularly, to litter collecting apparatus towed by automotive vehicles to remove surface litter.

BACKGROUND ART

The objectionable presence of litter scattered over relatively large areas, such as streets, highways, parking lots, parks and other recreational areas is both unsightly and expensive to remove. While prior art equipment for removing and collecting litter are generally more efficient than manual labor, to my knowledge, such equipment fails to remove all litter from the ground, especially over terrain of varying contour.

A common type of litter collecting device typically includes a single pick up roller or drum rotatably supported on a frame moveable over the ground. Resilient fingers project from the roller to entrap litter therebetween during rotary contact with the ground. The entrapped litter is then lifted from the ground by the fingers as the drum rotates. A smaller, elevated brush roller downstream from the pick up roller removes and transfers entrapped litter from the fingers for discharge into a trash bin carried by the frame. (See, for example, U.S. Pat. Nos. 3,923,101 and 3,993,141 to Donahue).

While the above device is somewhat effective to remove certain types and quantities of litter scattered over relatively large areas, the rotating pick-up fingers often fail to initially engage or retain entrapped litter for subsequent removal by the elevated brush roller. Consequently, substantial quantities of litter remain on the ground. Additionally, substantial quantities of litter lifted by the fingers are often ejected back onto the ground by the rotating brush roller.

Another type of litter collecting apparatus utilizes a tandem pair of identical, oppositely rotating rollers, as disclosed in U.S. Pat. No. 2,916,753 to Redpath et al. Each roller supports respectively intermeshing plural fingers engageable with the ground. This type of prior art apparatus tends to lift greater quantities of litter from the ground than the single roller-elevated brush arrangement discussed above does, since litter not grasped by the front roller fingers is usually lifted by the rear roller fingers.

To transfer litter to a downstream conveyor for discharge in a rear trash bin, Redpath et al uses plural elevated, fingered rollers meshing with front and rear fingered, ground level rollers. The elevated and ground level rollers convey litter downstream along an arcuate transfer path above the ground level rollers. Difficulties are encountered, however, in maintaining precise control over transfer of litter entrapped between the fingers of the ground level rollers. Specifically, there is a tendency for the elevated rollers to redeposit entrapped litter onto the ground since the fingers cannot maintain positive control over all types of litter for movement to the conveyor within the same transfer path. Also, whereas the rollers yield to uneven terrain, the equipment is complex and cumbersome, increasing production and maintenance costs.

It is accordingly an object of the present invention to provide a litter collecting apparatus capable of completely removing all types of surface litter.

Another object is to provide an apparatus having a unique pick up roller assembly capable of maintaining positive control to accurately transfer litter from the pick up rollers to a trash collection drum with no appreciable spillage.

Yet another object of the invention is to provide a mobile apparatus that automatically picks up bottles, cans, paper and other litter scattered over relatively large areas, such as streets, highway areas, parking lots, drive-in theaters and recreational areas.

Still a further object is to provide an apparatus having a pick up roller assembly that vertically yields to uneven terrain, preventing damage to working parts by knolls, depressions and the like.

Yet a further object is to provide an apparatus that is simple in construction, economical and can be towed by a lightweight automotive vehicle to completely remove litter within the travel path of the vehicle.

Still another object is to provide a litter collecting apparatus that is rugged and operates reliably in hostile environments.

DISCLOSURE OF THE INVENTION

A litter collecting apparatus, according to the present invention, comprises a mobile main frame carrying in tandem a pair of front and rear rotatable pick up rollers. A plurality of fingers project outwardly from each pick up roller drum to entrap ground litter. The front and rear roller fingers mesh with each other to dislodge entrapped litter. A pair of wiper racks above the rollers preveht litter from dropping from the roller fingers to the ground while transferring the dislodged litter to a main frame conveyor.

Preferably, each front and rear roller is rotatably secured to a carriage which is pivotally connected to the main frame. The carriage allows the rollers to yield vertically to pick-up litter on uneven terrain. The fingers are formed from resilient material and arranged in circumferentially spaced rows extending between parallel carriage side frames along substantially the entire outer surface of each roller.

A gear box controlled by a ground engaging idler wheel rotatably secured to the carriage rotates the front and rear rollers in opposite directions so that the fingers on the two drums approach and mesh with each other from the ground.

The stationary racks are identical to each other and respectively mounted at upstream and downstream ends of the rollers to dislodge litter entrapped between the front and rear roller fingers and define a transfer path therewith. The upstream rack includes a plurality of parallel, rigid tines that project downwardly to mesh with and wipe the front roller fingers. The tines are inclined upstream toward the front roller to define an acute angle with the intermeshing front fingers. These tines direct dislodged litter to the rear fingers. The downstream rack intermeshes with and wipes the rear fingers to completely dislodge any litter therefrom, causing litter to discharge into the conveyor.

A protective cage having top and side cover members attached to the carriage defines the upper bound of the transfer path above the rollers and wiper racks and cooperates with the side covers to deflect litter thrown upwardly by the intermeshing front and rear roller fingers back into the path.

The conveyor preferably includes a pair of parallel, inclined side members attached to the main frame to rotatably support idler rollers defining upstream and downstream ends of the conveyor. An endless flighted conveyor belt having spaced rows of fingers is supported by the rollers so that the upstream end is positioned below the downstream rack blade to receive litter discharged from the transfer path. Litter is conveyed by the fingers along the upper run of the conveyor for discharge into a stationary trash drum. A conveyor housing defining a trough extending along the lower conveyor run assures that litter failing to engage the upper run collects in the trough. As the conveyor fingers move along the lower run through the trough, litter collecting therein is carried onto the upper run for discharge in the trash drum.

In a second embodiment of the invention, the trash drum is pivotally secured to the apparatus with a pair of connecting arms attached to a pivot shaft rotatably supported on the main frame. A sprocket gear arrangement driven by a motor rotates the shaft to pivot the drum from a lower position receiving litter from the conveyor to an elevated litter dumping position.

In a third embodiment, a box-like main frame is supported in elevated position above the ground, attached to a rear end panel of a dump truck. A roller carriage is pivotally secured to the main frame to engage the ground laterally adjacent the vehicle travel path. Front and rear tandem rollers within the carriage convey litter picked up by the front and rear roller fingers to an auger conveyor located downstream from the rear roller. The auger conveyor laterally conveys litter transferred by the roller fingers for discharge into a hopper attached to the main frame. A conveyor provided on the main frame conveys litter along an inclined feed path from the hopper into the dump truck.

Additional objects, advantages and novel features of the invention will be set forth in part in the description which follows and in part will become apparent to those skilled in the art upon examination of the following and may be learned by practice of the invention. The objects and advantages of the invention may be realized and attained by means of the instrumentalities and combinations particularly pointed out in the appended claims.

DETAILED DESCRIPTION OF THE DRAWINGS

Figure 1B:
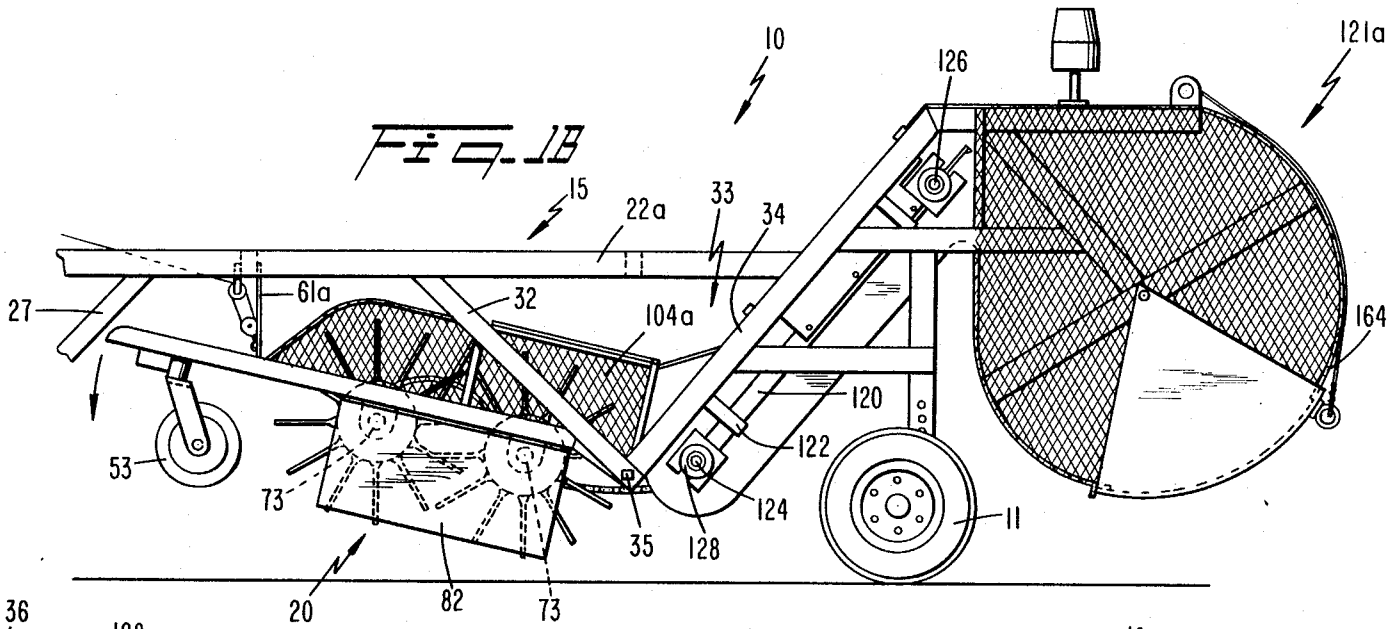
FIGS. 1*a* and 1*b* respectively right and left side elevational views of the litter collector apparatus according to a first embodiment of the present invention.
Figure 1A:
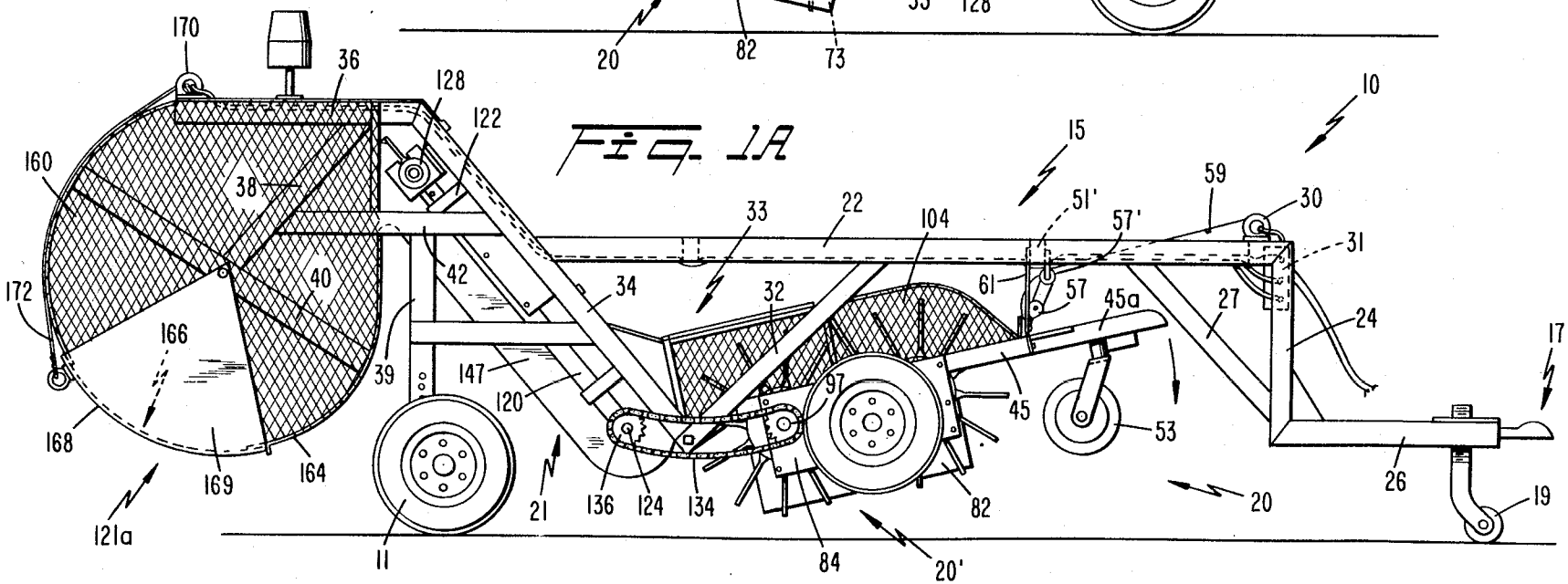
Figures 2, 3, 4:
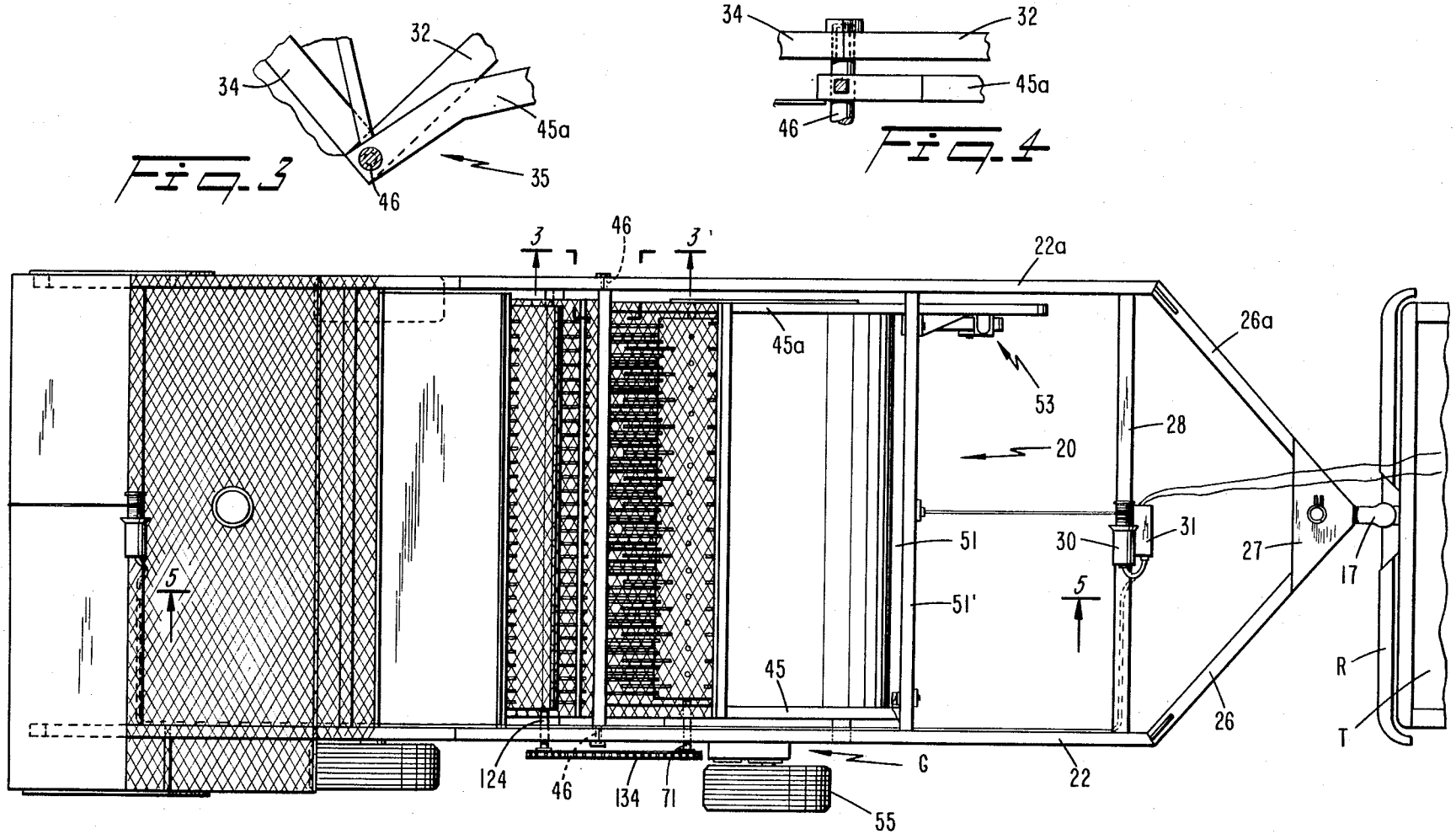
FIG. 2 is a top plan view of the apparatus illustrated in FIGS. 1*a* and 1*b* being towed by a lightweight pick up truck.
FIG. 3 is an enlarged, partial sectional view taken along the line 3—3 of FIG. 2, showing pivotal interconnection of the roller carriage frame to main frame side trusses.
FIG. 4 is an enlarged, partial sectional top view taken along the line 4—4 of FIG. 2 to further illustrate the connection shown in FIG. 3.

Referring to FIGS. 1*a* and 1*b*, a litter collector 10 includes a main, generally horizontal, rigid frame 15 fabricated from a number of steel frame members welded or otherwise secured together, supported on the ground by a pair of rear wheels W and a front, rotatable guide wheel 19. A hitch 17 is provided at the forward end of frame 15 to connect collector 10 to rear bumper R of a lightweight pickup truck T (FIG. 2). A litter pickup carriage 20, pivotally secured to main frame 15, includes a unique pickup roller assembly 20' capable of following the ground contour to completely remove litter therefrom. Litter is conveyed from roller assembly 20' by a conveyor 21 to a stationary rear trash drum 21*a*. Both conveyor 21 and drum 21*a* are mounted on main frame 15 in a unique manner to prevent spillage of litter after initial removal from the ground.

As illustrated in FIGS. 1 and 2, main frame 15 includes a pair of parallel, horizontally extending frame members 22 and 22*a*. The forward end of each member 22, 22*a* is connected to a pair of vertical frame members 24, respectively, which project downwardly for respective attachment to a pair of horizontal frame members 26 and 26*a*. Both members 26, 26*a* converge forwardly for interconnection to a hitch support plate 27 to which front wheel 19 is attached. Diagonal brace members 27 structurally interconnect support members 22, 24 and 22*a*, 24, respectively. A cross brace 28 extends transversely to structurally interconnect forward ends of members 22, 22*a*. A power winch 30 and control box 31 are secured to cross brace 28, for purposes described below.

A pair of parallel, V-shaped side trusses 33 support litter pickup carriage 20 and conveyor 21 on main frame 15. As shown in FIGS. 1*a* and 1*b*, trusses 33 are laterally spaced in corresponding position to each other. Each truss 33, respectively includes a rearwardly extending, inclined side frame member 32 secured at their upper ends to intermediate portions of horizontal members 22, 22*a*, respectively, to project downwardly therefrom. A second pair of oppositely inclined side frame members 34, having lower ends fixedly attached to corresponding ends of frame members 32 at 35, project upwardly for attachment to rear ends of members 22, 22*a*, respectively, at intermediate portions thereof. Carriage 20 is pivotally mounted between trusses 33, at 35. Each side member 34 projects rearwardly above horizontal members 22, 22*a* to support conveyor 21, extending between these side members, as set forth below.

To support trash drum 21*a* on main frame 15, a pair of parallel, horizontal support members 36 are respectively attached to upper ends of inclined members 34 and project rearwardly therefrom to define the uppermost extent of the trash drum. A pair of downwardly inclined side frame members 38, having upper ends attached to forward portions of top members 36, respectively, project below the top members to support a pair of side frame members 40, defining lateral end walls of trash drum 21*a* therewith. Side members 40 are connected at their intermediate portions to lower ends of members 38 (FIG. 1*a*). A pair of horizontal side support members 42, rigidly interconnect lower portions of downwardly inclined members 38, to intermediate portions of upwardly inclined members 34 respectively, to further support the drum on main frame 15.

Figures 5, 6, 7:
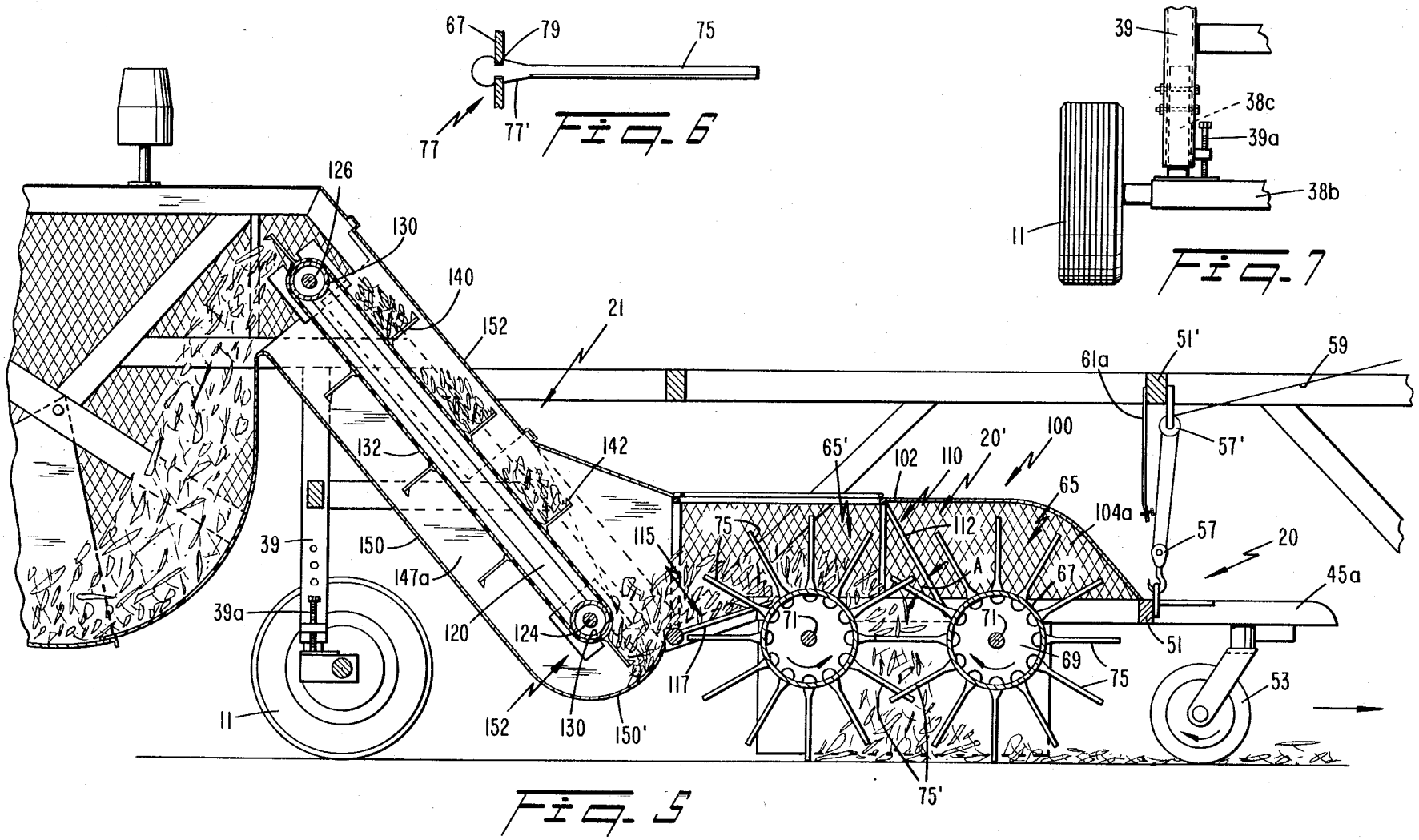
FIG. 5 is a sectional view taken along the line 5—5 of FIG. 2 illustrating the front and rear pick up rollers on the ground picking up surface litter and moving the litter along the transfer path for discharge into the conveyor.
FIG. 6 is a detailed view of a roller finger used to pick up litter lying on the ground.
FIG. 7 is a partial, rear elevational view of a height adjustment means for controlling the height of the main frame relative to the ground.

As illustrated in FIGS. 5 and 7, rear ground engaging wheels 11 are located between conveyor 21 and drum 21*a* upon a rear axle 38*b*. Axle 38*b* is connected to main frame 15 by a pair of vertical support members 39 attached to member 42. More specifically, as best illustrated in FIG. 7, support members 39 are hollow tubular structures receiving, through their lower open ends, upwardly projecting extensions 38*c* of the rear axle. Extensions 38*c* are axially movable within the lower ends of members 39 with height adjustment screw 39*a* to vary the height of roller assembly 20' relative to the ground surface, as explained infra. Screw 39*a* is threadably connected to member 39 and bears against axle 38*b* to vary the main frame height.

Litter pickup carriage 20, as mentioned briefly above, includes a unique roller assembly 20' used to pick up and transfer litter lying on the ground to conveyor 21. Carriage 20, as best shown in FIG. 2, is a rectangular frame having a pair of parallel, horizontally extending frame members 45, 45*a* laterally spaced from each other between main frame members 22, 22*a*. Rear ends of members 45, 45*a* project downwardly for rigid attachment to a pivot shaft 46. As shown in FIGS. 3 and 4, the shaft 46 extends transversely to pivotally interconnect carriage 20 to main trusses 33, at 35. Forward portions of members 45, 45*a* are rigidly interconnected with a transversely extending cross brace 51 to complete the rectangular carriage frame.

Carriage 20 is supported for travel in ground engaging position with a single front wheel 53 attached to the front end of member 45*a* and a drive wheel 55 (discussed below) rotatably supported by member 45. The positioning of wheels 53, 55 laterally adjacent the travel path of roller assembly 20' prevents the wheels from crushing litter into the ground, to assure proper pickup by the rollers (FIG. 2).

A pair of pulleys 57 and 57', respectively attached to cross brace 51 and an upper cross brace 51' (extending transversely to structurally interconnect main frame members 22, 22*a*), are interconnected to power winch 30 with a cable 59 to pivot carriage 20 into and out of ground engaging position about the pivot shaft 46. A limit switch, attached to cross brace 51, limits upward pivotal movement of carriage 20. A pair of connecting arms 61, 61*a*, attached to upper brace 51', project downwardly for selective attachment to brace 51 by the operator when it is desired to pin carriage 20 in raised position for extended travel between litter collection locations (see FIGS. 1*a* and 5).

FIG. 5 illustrates roller assembly 20' in ground engaging position. The assemby 20' comprises identical front and rear rollers 65 and 65'0 rotatably mounted to carriage 20 in tandem arrangement. More specifically, each roller 65, 65' includes a hollow, steel cylindrical drum 67 extending transversely the full width between carriage frame members 45, 45*a* (i.e., approximately six feet in the preferred commercial embodiment). A pair of end walls 69 on each drum 67 support a shaft 71 extending the full width of each roller, as best shown in FIGS. 1*a* and 5. Each shaft 71 is journalled in a pair of bearings 73 secured respectively to carriage frames 45, 45*a* (not shown in detail) to rotatably support rollers 65, 65' within the carriage frame. Corresponding ends of each shaft 71 project outwardly from frame member 45 into a gear box 66 to impart reverse rotational movement to rollers 65, 65', as described hereinafter.

Resilient finger means is provided on each roller 65, 65' to enable litter to be grasped between adjacent fingers and picked up from the ground during rotation of the rollers. As best illustrated in FIGS. 5 and 6, such finger means preferably includes circumferentially spaced rows of identical, axially spaced flexible fingers 75. Fingers 75 project outwardly to completely cover the outer surface of each drum 67. Preferably, adjacent fingers 75 are axially spaced approximately four inches apart while adjacent rows are spaced approximately three and one half inches apart from each other. Furthermore, fingers 75 forming one row are axially offset about two inches with respect to fingers provided in an adjacent row, to assure proper intermeshing engagement between fingers provided on rollers 65, 65', respectively.

As shown in FIG. 6, each pickup finger 75 is substantially cylindrical, of about three-quarters inch diameter and approximately ten inches in length. Preferably, each flexible finger 75 is molded from urethane material and includes a bulging attachment end 77 provided with an annular locking groove 79 capable of resilient locking engagement with receiving apertures formed in cylindrical drums 67. Bulging portion 77 forms a shoulder 77' engaging the outer surface of cylindrical drum 67 to support finger 75 in upright position, thus assuring proper performance of its ground and litter engaging function.

Gear box 66, as best shown in FIGS. 2 and 8–10, includes a gearing arrangement operated by drive wheel 55 in contact with the ground to rotate pickup rollers 65, 65' in opposite directions. Gear box G includes an inner housing 80 comprising a pair of side angle members attached vertically to carriage frame member 45 in longitudinal spaced relationship. A steel plate 84 extends longitudinally between the side angle members and supports a second housing 80' attached thereto. Plate 84 is further dimensioned to substantially cover the area located laterally adjacent rollers 65, 65' to prevent litter picked up by fingers 75 from being inadvertently thrown laterally out of the roller travel path. As shown in FIGS. 1*a* and 1*b*, a shield 82 is attached to carriage frame member 45' in corresponding location to plate 84 and is effective to provide a similar function of preventing lateral discharge of litter from the opposite side of carriage 20. The members 84 and 86 cooperate to prevent litter engaging the fingers 75 beneath the rollers from being thrown laterally out of the travel path, thereby assuring that all litter remains in the path for pick-up by the fingers.

Figure 8:
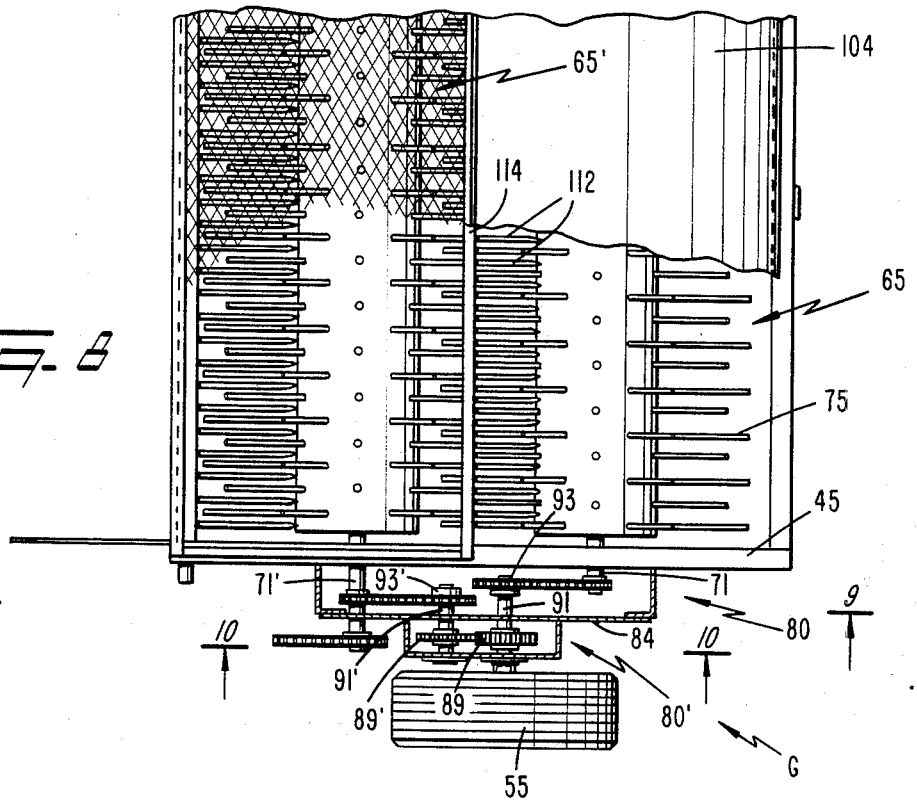
FIG. 8 is an enlarged, partial top plan view of the pick up roller assembly.
Figure 9:
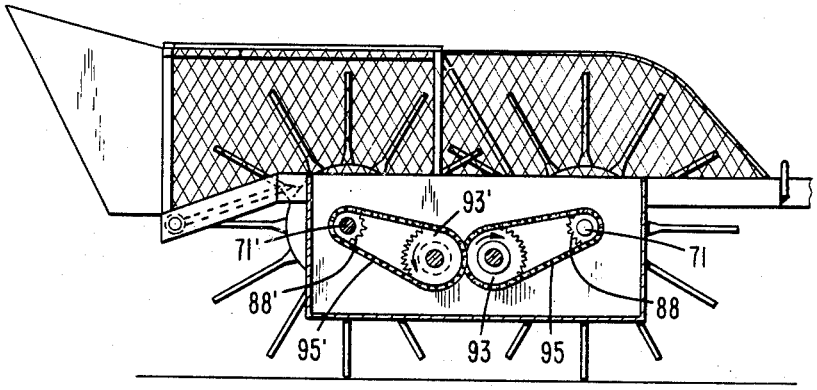
FIG. 9 is an enlarged, partial sectional view taken along the line 9—9 of FIG. 8, illustrating the drive wheel and sprocket gearing arrangement connected to impart reverse rotation to the pick up rollers.
Figure 10:
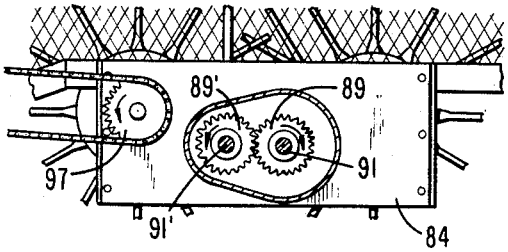
FIG. 10 is an enlarged, partial sectional view taken along the line 10—10 of FIG. 8, further illustrating the gearing arrangement used to drive the pick-up rollers and the conveyor.

FIG. 8 illustrates corresponding ends of roller support shafts 71 projecting into housing 80. To impart reverse rotational movement to the support shafts, sprocket gears 88, 88' are keyed to the shaft ends and interconnected for opposite rotation via a pair of intermeshing gears 89, 89'. Gears 89, 89' are located within second housing 80' and are respectively keyed to outer ends of stub shafts 91, 91' extending into the second housing. Shafts 91, 91' are rotatably supported by plate 84 and support within housing 80 a pair of sprocket gears 93, 93' keyed to their inner ends, respectively. A pair of endless chains 95, 95' are respectively trained around sprocket gear pairs 88, 93 and 88', 93'. Drive wheel 85 is connected to provide direct drive to shaft 91 in position on the ground causing front roller 65 to rotate in the same direction as the drive wheel (i.e., clockwise during forward movement of the collector 10). Gears 89, 89' rotate shaft 71', causing rear roller 65' to rotate in a direction opposite that of the front roller. Since the gear ratio is 1:1, rollers 65, 65' rotate in corresponding, constant velocity movement at a constant forward speed of drive wheel 55. A sprocket gear 97 keyed to the outer end of rear shaft 71' is provided to drive conveyor 21, as explained hereinafter.

FIG. 5 illustrates roller assembly 20' in the ground engaging position to pick up litter during forward movement of apparatus 10. As front roller 65 rotates, the free ends of resilient fingers 75 progressively rotate downwardly clockwise from a position forward of the front roller into contact with the ground. As fingers 75 engage the ground, their resiliency allows them to flex and gently spread apart, causing litter to become entrapped between adjacent fingers beneath the front roller. Continued rotation causes fingers 75 to advance out of ground engagement and resume their straight position, causing litter now entrapped between adjacent fingers to be lifted from the ground. Fingers 75 carry litter along an arcuate path towards rear roller 65'.

As a row of front roller fingers 75 advance upwardly toward a corresponding row of identical rear roller fingers for intermeshing engagement, the relative positioning of fingers between the adjacent rollers is effective to allow the rear roller fingers to initially engage the front roller fingers from beneath. Thus, as fingers 75 begin to intermesh beneath the center position of the rollers (see fingers 75' in FIG. 5), the rear roller fingers initially engage litter entrapped between the front roller fingers from below, advantageously avoiding any intermeshing contact that would otherwise wedge entrapped litter more deeply into the front roller fingers. As fingers 75 rotate upwardly above the center position of the rollers, the rear roller fingers exert an upward counterclockwise force on litter entrapped between the front roller fingers. Simultaneously, front roller fingers 75 begin to rotate upwardly in the clockwise direction to disengage from the rear roller fingers. This combined motion advantageously causes entrapped litter to be lifted and dislodged from the front roller fingers to be carried by the rear roller fingers upwardly over rear roller 65' for discharge into conveyor 21.

The feature of front and rear rollers 65, 65' cooperating in the aforesaid unique manner advantageously serves to remove most of the litter lying within the travel path of apparatus 10. Obviously, however, smaller pieces or excessive quantities of litter will either not engage with front roller fingers 75 or may fall from these fingers prior to meshing engagement with the rear fingers. In view of the aforesaid identical construction and alignment of the rollers, and the fact that the rollers extend continuously across the travel path, it will now be appreciated that rear roller 65', in addition to performing its function of transferring litter to conveyor 21, as above, uniquely serves to pick up litter not entrapped by the front roller fingers, thus assuring complete removal of litter from the ground surface. To explain, as second roller finger 75 engage the ground in counterclockwise rotational movement towards the front roller uncollected litter either becomes entrapped between adjacent rear roller fingers or is swept upwardly into engagement with the intermeshing fingers via upward angular momentum imparted to the litter by the rotating fingers.

An elevated wiper rack 110 mounted within a cage 100 (described below) is provided to completely remove litter remaining entrapped between front roller fingers 75 after disengagement from the rear roller fingers. As illustrated in FIGS. 5 and 8, wiper rack 110 is a stationary, comb-like structure that includes a plurality of parallel tines 112 attached to a connecting web 114. Web 114 is attached to a top cover 104 to enable tines 112, arranged coplanar with each other, to project downwardly for intermeshing engagement with front roller fingers 75. Tines 112 extend the full length of roller 65 and are inclined to form an acute angle, preferably 20°, (see FIG. 5) with the front roller fingers (open toward rear roller 65') during meshing and are further dimensioned to wipe each finger. In this manner, tines 112 gradually advance any remaining litter entrapped within front fingers 75 towards their free ends until the litter is completely dislodged.

Rack 110 is further positioned so that the free ends of the rear roller fingers are slightly spaced from and below tines 112, enabling litter dislodged from the front fingers to freely fall directly onto the rear fingers.

The feature of wiper rack 110 advantageously assures complete transfer of litter from the front to rear fingers in view of the aforesaid positioning relative to the rear fingers. Further, the complete cleaning action afforded by wiper rack 110 prevents clogging of front roller fingers 75 with litter, assuring virtually uninterrupted, maintenance free operation.

To complete the transfer of litter from rear roller 65' to conveyor C, a second rack blade 115 is provided. As illustrated in FIGS. 5 and 8, blade 115 is identical to blade 110, described supra, and includes a plurality of coplanar, parallel tines 117 extending transversely between carriage side members 45, 45*a*. Rack 115 is fixedly attached to pivot shaft 46, enabling tines 117 to define a downwardly inclined feed path adjacent the upstream end of conveyor 21. Tines 117 form an acute angle of preferably 20° with the rear roller finger in the direction of conveyor 21. Thus, as the rear fingers descend and mesh with tines 117, the length of each tine is sufficient to wipe the entire length of each rear finger. In this manner, litter is completely stripped from these fingers to slide down the upper surface of the tines into the conveyor (see FIG. 5).

A cage 100 is provided above roller assembly 20' to prevent litter from being thrown upwardly out of the transfer path defined by upper portions of rollers 65, 65' and racks 110, 115 and back onto the ground. As best shown in FIGS. 2 and 5, cage 100 includes a top cover 102 extending transversely between carriage frame members 45, 45*a*. Top cover 102 extends forwardly from a point slightly downstream of rear roller 65' and includes a downwardly curved forward portion attached to members 45, 45*a* at a point upstream of front roller 65. Side cover members 104 and 104*a* connect top cover 102 to members 45, 45*a* to prevent lateral discharge of litter out of the transfer path. Preferably, top cover 102 and side covers 104, 104*a* are formed from expanded metal to allow visible inspection and easy cleaning of roller assembly 20'. As shown in FIG. 5, top cover 102 is spaced upwardly from the free end of fingers 75. This spacing prevents undesirable scraping action of fingers 75 against the lower surface of top cover 102 while allowing litter to deflect off the top cover for controlled movement within the transfer path.

Chain conveyor 21 is used to transport litter picked up by roller assembly 20' into trash drum as explained above. Chain conveyor 21, as best illustrated in FIGS. 1 and 5, includes a pair of parallel side frame members 120. The members 120 are attached to and below inclined main frame members 34, respectively, with support bars 122. A pair of shafts 124, 126 are rotatably supported on side frames 120 with bearings 128 at upstream and downstream ends thereof. Idler rollers 130 extend transversely between side frames 120 on each shaft 124, 126 to support an endless conveyor belt 132, preferably formed from synthetic material. As shown in FIGS. 1 and 2, a single endless chain 134 is trained around a sprocket 136 keyed to shaft 124 and sprocket gear 97 (see FIG. 8) to drive conveyor belt 132 so that the upper run moves counterclockwise towards the trash drum.

Rows of fingers 140 are uniformly spaced apart along the length of belt 132 to convey litter along the upper conveyor run. As shown in FIG. 5, each row includes a plurality of equispaced fingers projecting upwardly above the belt surface across the full belt width. Each finger 140 is preferably formed from urethane material molded to belt 132. Fingers 140 are dimensioned to project slightly below and immediately adjacent the discharge end of downstream wiper blade 115. Each finger 140 includes a free end 142 angled in the direction of conveyor movement to assure positive retention of litter on the belt.

Chain conveyor 21 further includes a conveyor housing comprising side panel members 147, 147*a* attached to support members 120. Side members 147, 147*a* are positioned adjacent edges of belt 132 to define the lateral extent of the conveyor feed path. A bottom panel member 150 extends between lower edges of side panels 147, 147*a* below the lower run (see FIG. 5). A top member 152 extends between upper edges of the side panels to cover the upper run. The lower part of bottom panel member 150 extends beneath the upstream end of conveyor 21 and includes an upwardly curved portion 150' defining a trough 152. The portion 150' contacts wiper rack 115 to assure that litter being fed onto conveyor 21 is either conveyed by fingers 140 along the upper run or drops into trough 152. Trough 152 is spaced slightly below the free ends of fingers 140, as illustrated in FIG. 5.

The conveyor housing comprising side panels 147, 147*a*, bottom panel 150 and top panel 152 coact with fingers 140 to convey litter into the trash drum without spillage. To explain, as litter is discharged into the trash drum from the downstream end of conveyor 21, as shown in FIG. 5, the upward rotational momentum imparted by fingers 140 to litter conveyed along the upper run is usually sufficient to discharge the material directly into the drum. However, depending upon vehicular speed, which controls the velocity of both conveyor 21 and roller assembly 20' through drive wheel 55, there is occasionally a tendency for litter to be carried around the conveyor discharge end as a row of fingers 140 pass over downstream roller 130. Thus, particularly at low vehicular speeds, there is occasionally a tendency for litter to be carried back toward the upstream end of conveyor 21 along the lower run. Bottom panel 150 advantageously serves to direct litter entering the lower run into trough 152. As fingers 140 travel down the lower run into trough 152 around upstream roller 130, litter is scooped up by these conveyor fingers for travel along the upper run and discharge into the trash drum.

Of course, should litter initially discharged from roller assembly 20' fail to make positive contact with fingers 140, the provision of curved portion 150' advantageously assures that the litter will enter trough 152 and thereafter engage fingers 140 for movement along the upper run. In this manner, conveyor 21 advantageously prevents litter collected by roller assembly 20' from being redeposited upon the ground, avoiding a problem encountered in various prior art devices.

As mentioned above, main frame members 36, 38 define side support members for end walls of trash drum 21*a*. The end walls are defined by substantially circular pieces 160 of expanded metal attached to these support members. A substantially cylindrical member 164 extends transversely between end walls 160 to complete the drum and includes a rear discharge opening 166.

Opening 166 is selectively opened and closed by a curved plate 168 pivotally secured to members 40 with skirts 169. As shown in FIG. 1*a*, a power winch 170 located above the drum is interconnected to curved plate 168 via cable 172, causing the plate to travel in an arcuate path to selectively open and close discharge opening 166. Winch 170 is actuated by control box 31, as described hereinafter.

Figure 11:
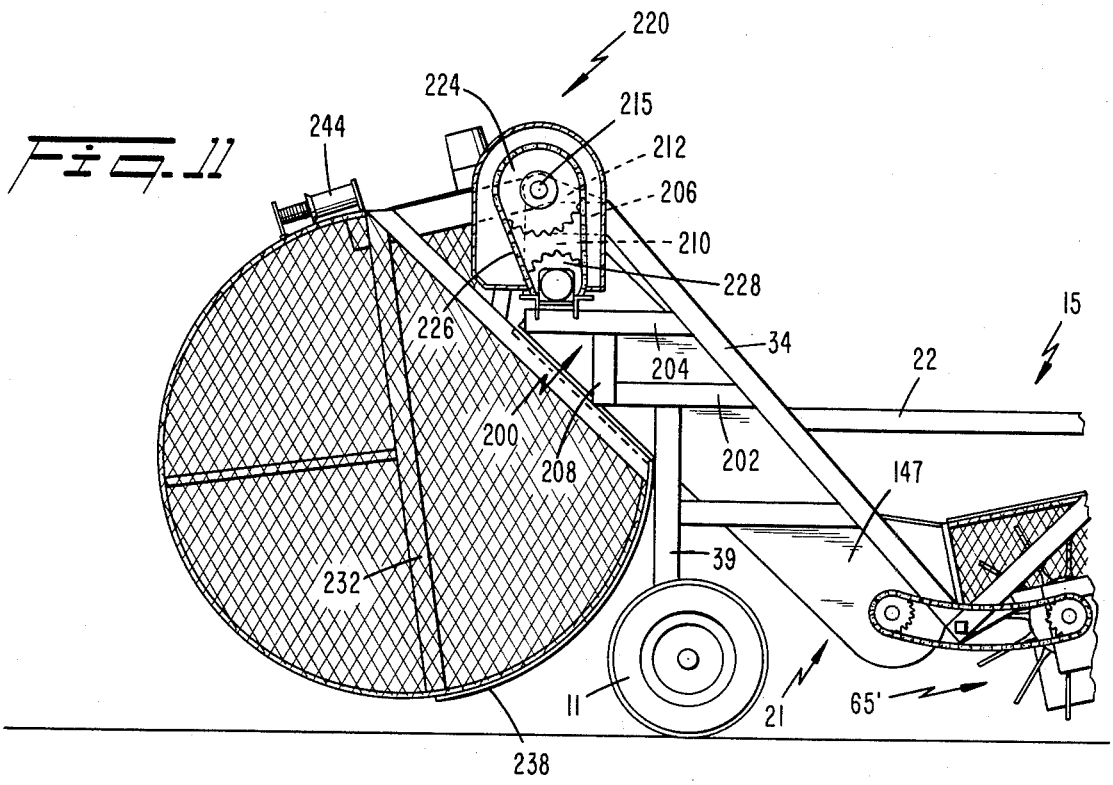
FIG. 11 is a partial side elevational view of the trash drum pivotally secured to the main frame in a lower position according to a second embodiment of the present invention.
Figure 12:
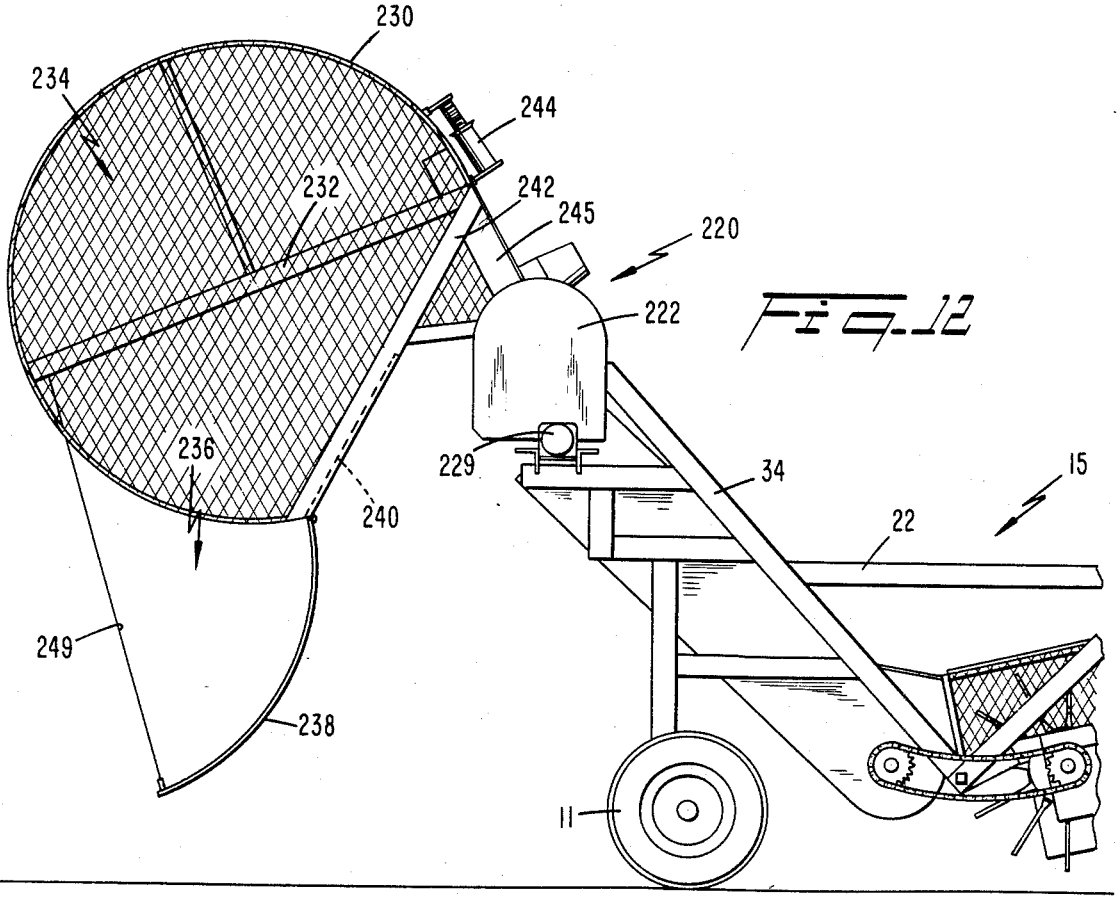
FIG. 12 is a view corresponding to FIG. 11, showing the trash drum in its elevated, trash discharging position.

FIGS. 11–14 illustrate a second embodiment of the invention, wherein trash drum 21*a* is pivotally supported on main frame 15 for movement between a lower, litter collecting position (FIG. 11) and a raised, litter discharging position (FIG. 12). In the second embodiment, upwardly inclined main frame members 34 and support members 39, discussed supra, cooperate to support a pair of parallel trusses 200. Support trusses 200 are respectively mounted in corresponding, laterally spaced relationship to each other adjacent upper portions of conveyor side panels 147, 147*a*. Each truss 200 includes horizontal, vertically spaced frame members 202, 204 and 206 projecting rearwardly from members 34. Vertical frame members 208 and 210 interconnect members 202, 204, and 204, 206 respectively to provide adequate support of the drum on the main frame.

Figure 13:
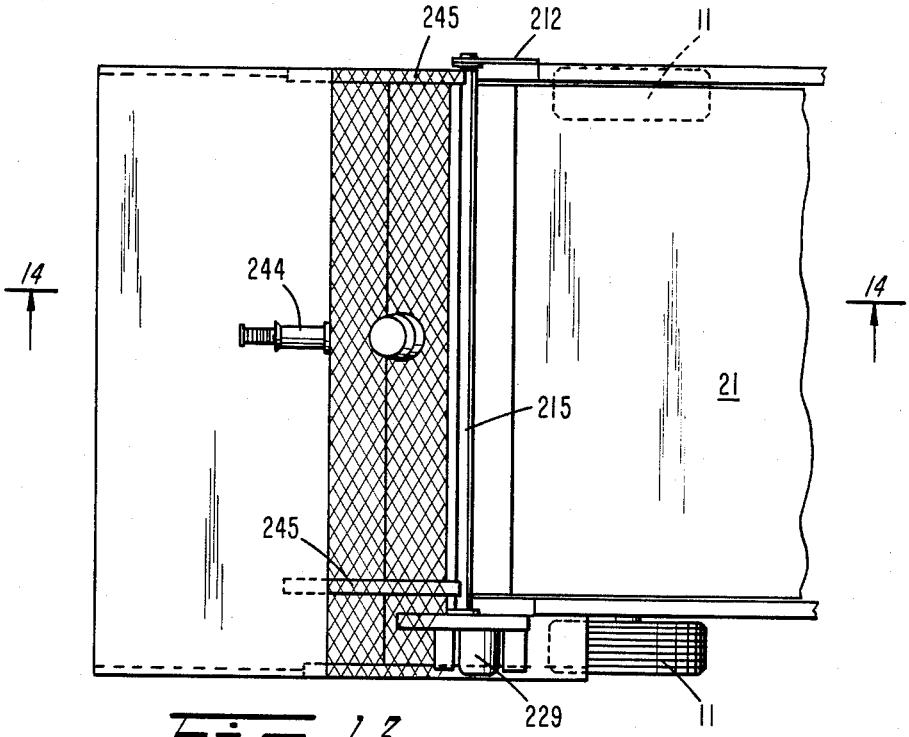
FIG. 13 is a partial top plan view of the drum illustrated in FIG. 11.
Figure 14:
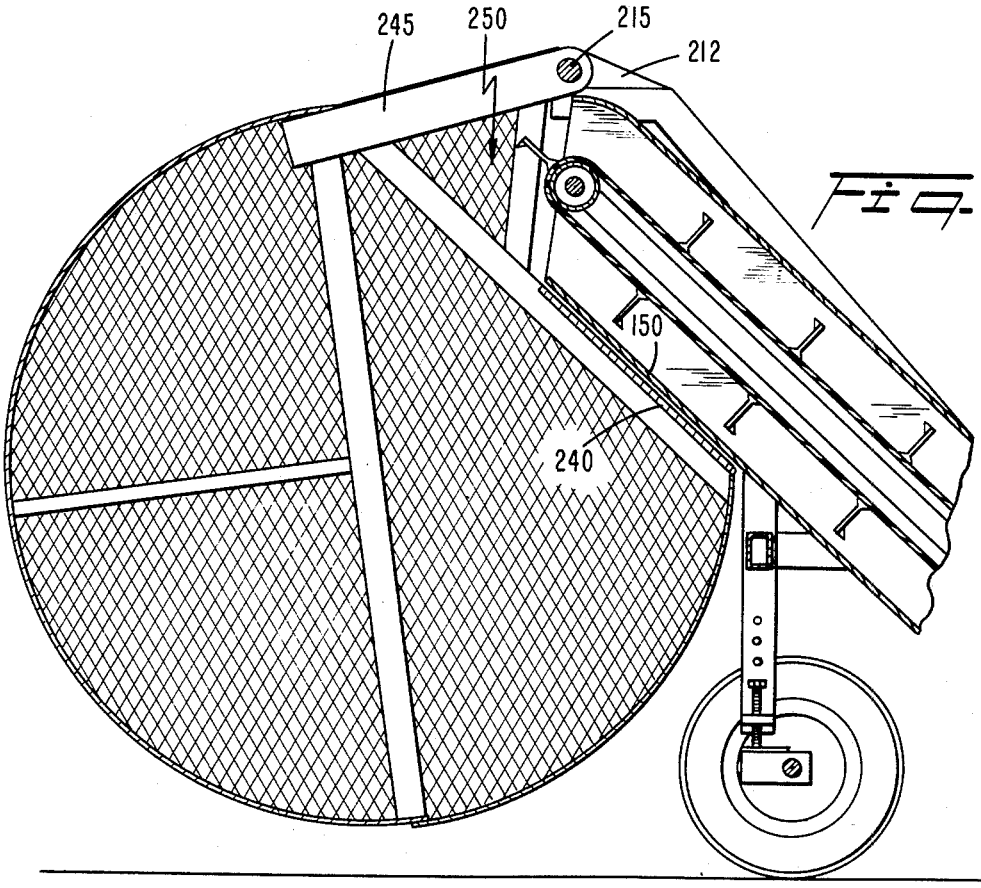
FIG. 14 is a partial sectional view taken along the line 14—14 of FIG. 13, illustrating the drum in its lower position in full communication with the discharge end of the conveyor.

A pair of upper mounting flanges 212 are respectively connected to top horizontal members 206 to rotatably secure a pivot shaft 215 extending transversely therebetween. Pivot shaft 215, as best illustrated in FIGS. 11 and 13, projects laterally outward from one of flanges 212 into a gearbox 220. Gearbox 220 includes a housing 222 attached to one of frame members 204 at the upper end of conveyor 21. A sprocket gear 224 provided at the upper end of housing 222 is keyed to shaft 215. Sprocket 224 is connected by a single endless chain 226 to a driving sprocket 228 keyed to the motor shaft of a reversible motor 229. The motor is actuated by control box 31, causing rotation of shaft 215 to pivot trash drum 21*a* about the shaft axis.

As best illustrated in FIG. 12, trash drum 21*a* is generally of cylindrical construction and includes a semicylindrical metallic side wall 230 which subtends an arc of approximately 180°. A pair of laterally spaced, parallel side members 232 extend along the diametrical axis of the drum to support side walls 230. Circular end walls 234, preferably formed from expanded metal to effect easy cleaning of drum 21*a*, are attached to members 232. A discharge opening 236 formed in side walls 230 is covered by a curved door 238. Door 238 is hinged to an abutment plate 240 extending transversely between a pair of side members 242. The members 242 interconnect the lateral ends of side walls 230. A power winch 244, actuated by control box 31, is mounted on side wall 230 in diametrically opposed relation to curved door 238 to operate the door via cable 249.

Drum 21*a* is pivotally attached to shaft 215 with a pair of parallel, laterally spaced connecting arms 245. As illustrated in FIG. 13, connecting arms 245 are fixedly secured to shaft 215 and assist in defining an inlet opening 250 located between the arms and abutment plate 240. In the lower position of drum 21*a*, abutment plate 240 lies flush against conveyor bottom panel 150 to accurately position inlet 150 in full communication with the downstream end of conveyor 21 (see FIG. 14).

The feature of pivotally supporting drum 21*a* on main frame 15 in the aforesaid manner enables apparatus 10 to discharge collected litter into conventional dumpsters positioned upright on the ground. To raise the drum, motor 229 is first actuated by control box 31, causing shaft 215 to rotate clockwise. Connecting arms 245 pivot upwardly about the shaft axis causing corresponding movement of the drum until discharge opening 236 is elevated to its proper height necessary to offload the contents of the drum. At this point, winch 244 is actuated by control box 31 to uncover the discharge opening, thus allowing the contents of the drum to discharge therefrom by gravity. When the drum is emptied, winch 245 closes door 238. Thereafter, reversable motor 229 rotates shaft 215 counterclockwise to return the drum to its lower position. With drum 21*a* pivotally supported by main frame 15, the ability of apparatus 10 to offload collected litter into different types of containers or areas is greatly improved.

Figure 15:
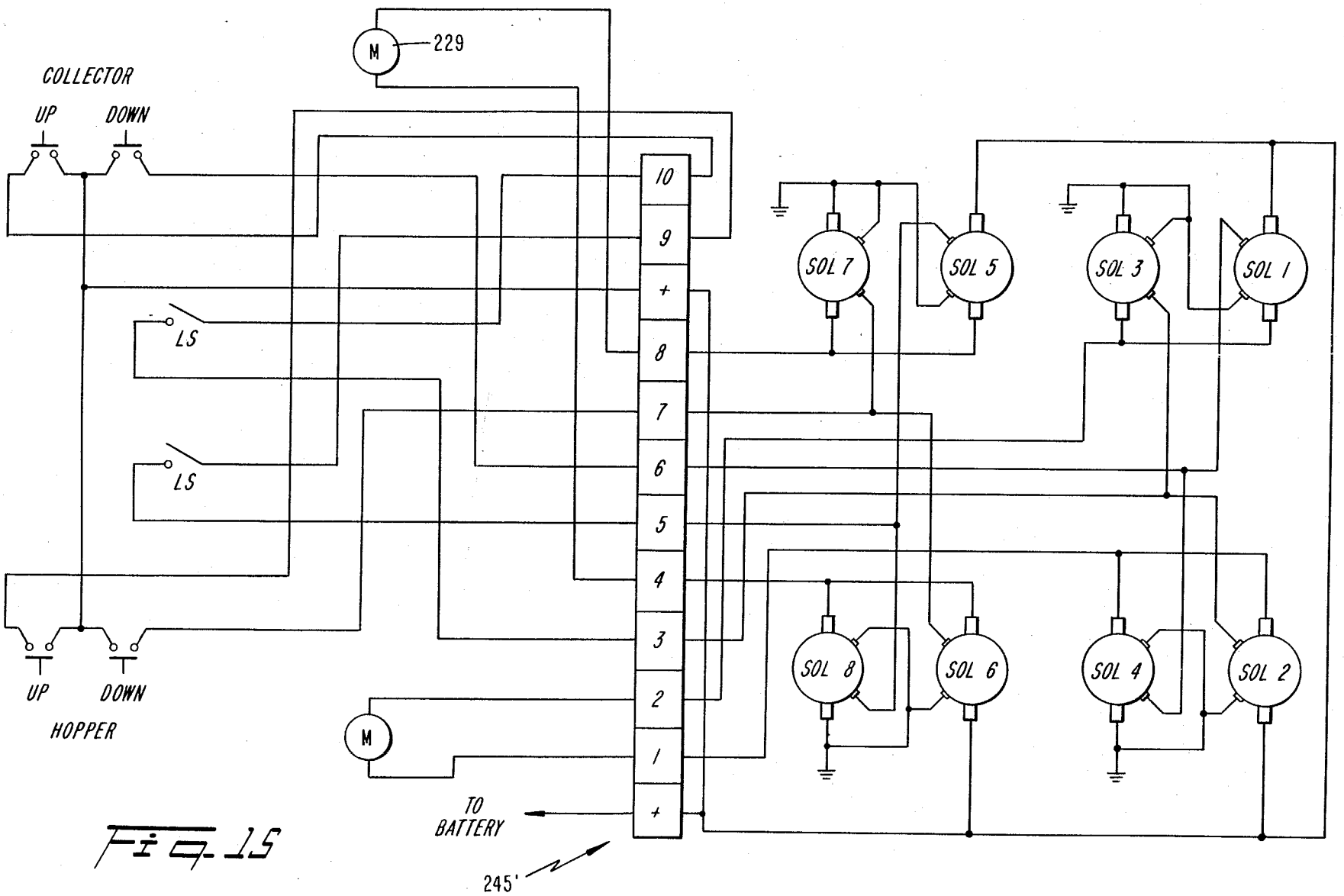
FIG. 15 is an electrical schematic diagram of a control box mounted on the main frame for controlling power winches used to pivot the roller assembly into and out of ground engaging position as well as pivot the trash drum.

FIG. 15 illustrates an electrical, schematic diagram showing the circuitry used to electrically interconnect control box 31 to motor 229, power winches 30, 245 and lights mounted atop apparatus 10 to a switch panel 245' located in the vehicle cabin. Plural solenoids, numbered 1–8 in FIG. 13, are located within control box 31 in series relationship with an array of switches provided within panel 245'. By depressing appropriate switches, the vehicle operator can actuate appropriate solenoids to selectively operate the motor, power winch mechanisms, or lights described supra, from within the vehicle cabin.

From the foregoing description, it will be appreciated that apparatus 10 is basically simple in design yet extremely effective to completely remove litter from the ground when towed behind a lightweight pick-up truck or passenger vehicle. The use of power winch 30 to raise and lower roller carriage 20, for example, in easy pivoting movement, is also effective to enable fine height adjustment of front roller fingers 75 relative to the ground surface. Alternatively, by operating winch 30 to provide some degree of slack in cable 59, rollers 65, 65' are allowed vertical freedom of movement, enabling fingers 75 to engage and pick up litter on uneven terrain.

The feature of imparting reverse rotational movement to the pick-up roller assembly with ground engaging drive wheel 55 and gearbox 66 which simultaneously drives conveyor 21 avoids the need for additional engines or supplemental sources of power. Further, the unique transfer path defined by upper portions of front and rear rollers 65, 65' cooperating with wiper racks 110, 115, as described above, effectively assures that surface litter picked up by fingers 75 is not redeposited on the ground. Cage 100, defining the upper and lateral extent of the transfer path, assists in retaining litter within the path, even under rugged and bumpy ground surface conditions when abrupt changes in motion imparted to the pick up carriage are likely to occur.

Figure 16:
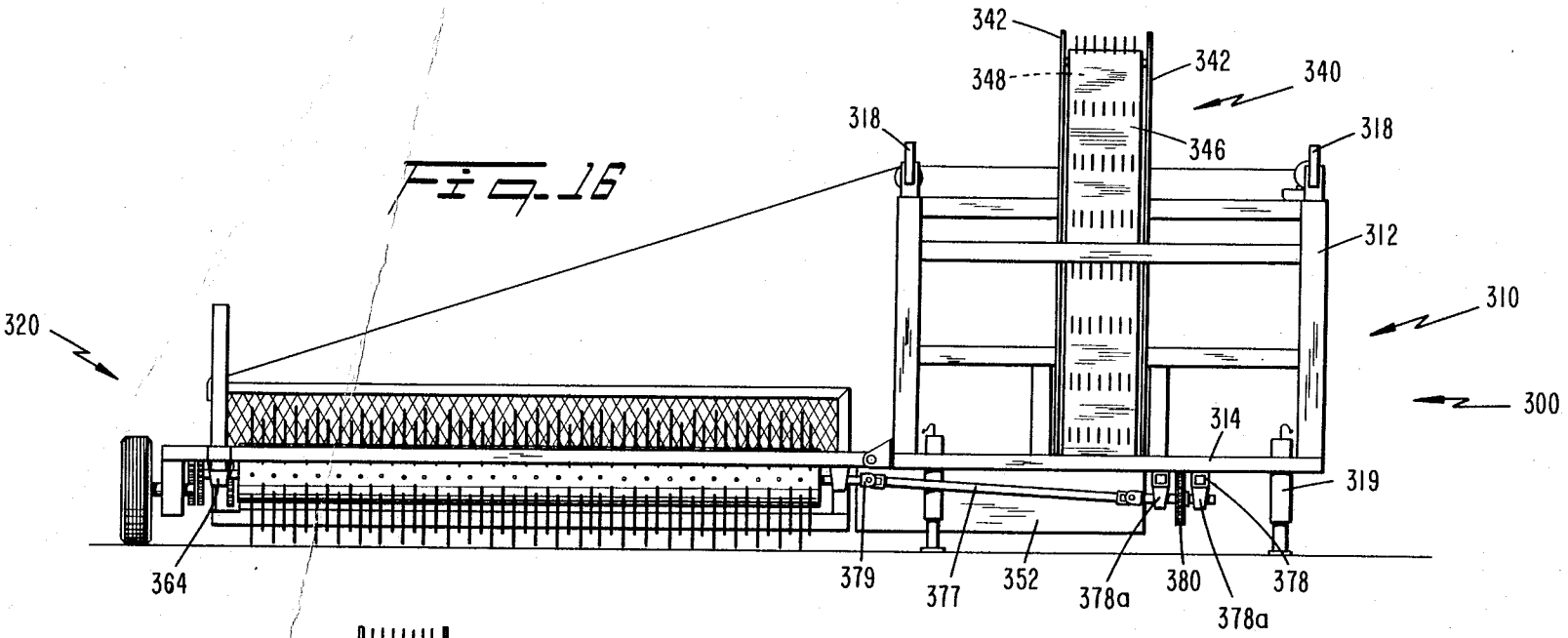
FIG. 16 is a front elevational view of a litter collecting apparatus according to a third embodiment of the present invention, illustrating a box-like main frame pivotally connected to a pick up roller assembly shown in ground engaging position laterally adjacent the main frame.
Figure 17:
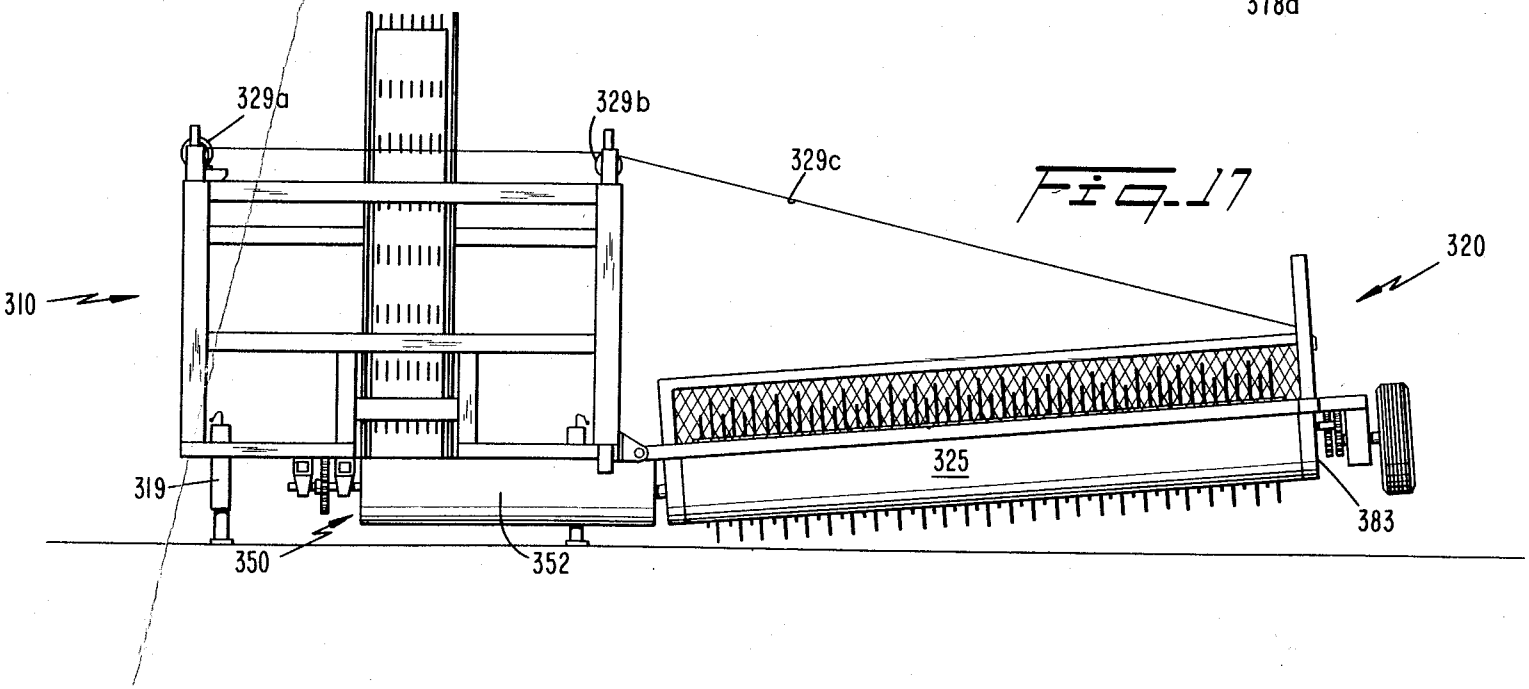
FIG. 17 is a rear elevational view of the apparatus illustrated in FIG. 16.
Figure 18:
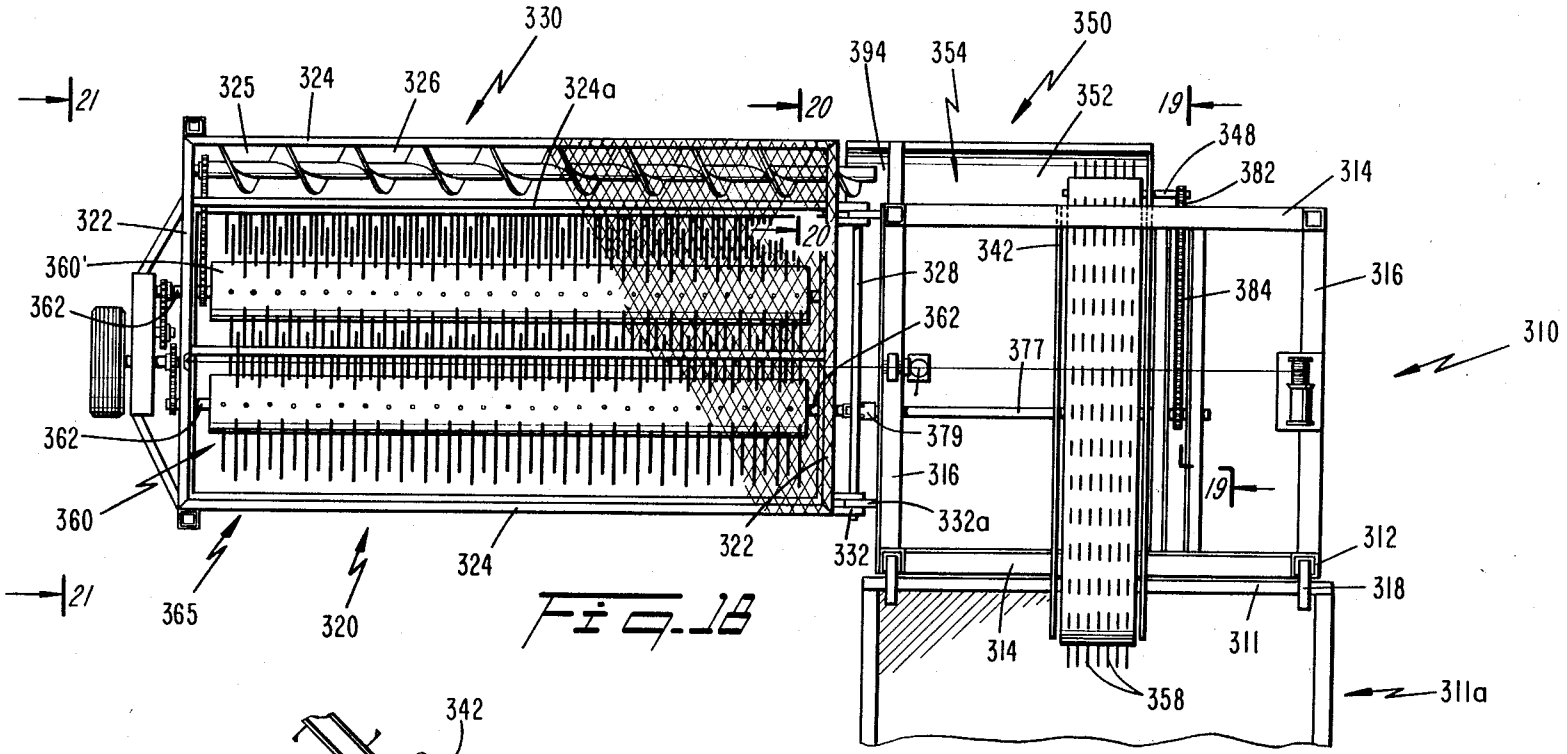
FIG. 18 is a top plan view of the apparatus shown in FIG. 16, illustrating the main frame attached to a rear panel door of a dump truck.
Figure 20:
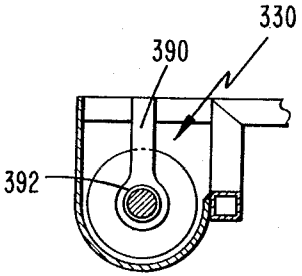
FIG. 20 is an enlarged, partial sectional view taken along the line 20—20 of FIG. 18 to illustrate a means for mounting the discharge end of the auger conveyor to the roller carriage frame.
Figure 21:
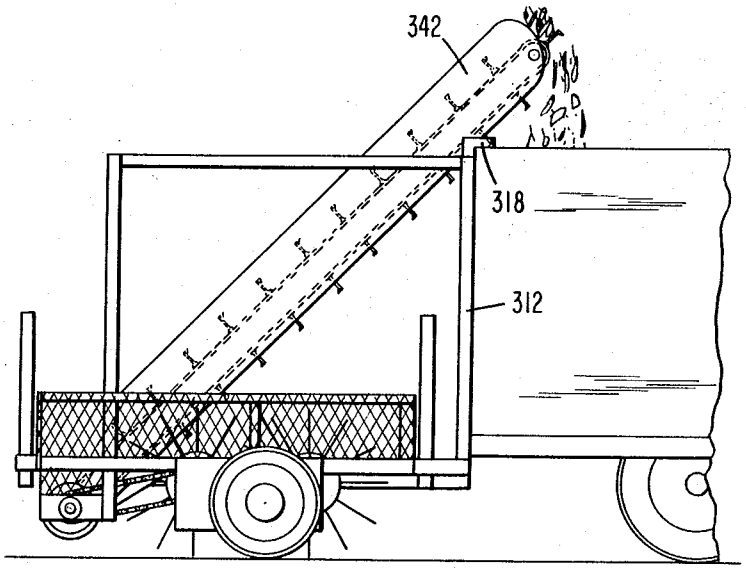
FIG. 21 is a side elevational view taken along the line 21—21 of FIG. 18, illustrating the apparatus during litter pickup operation.
Figure 22:
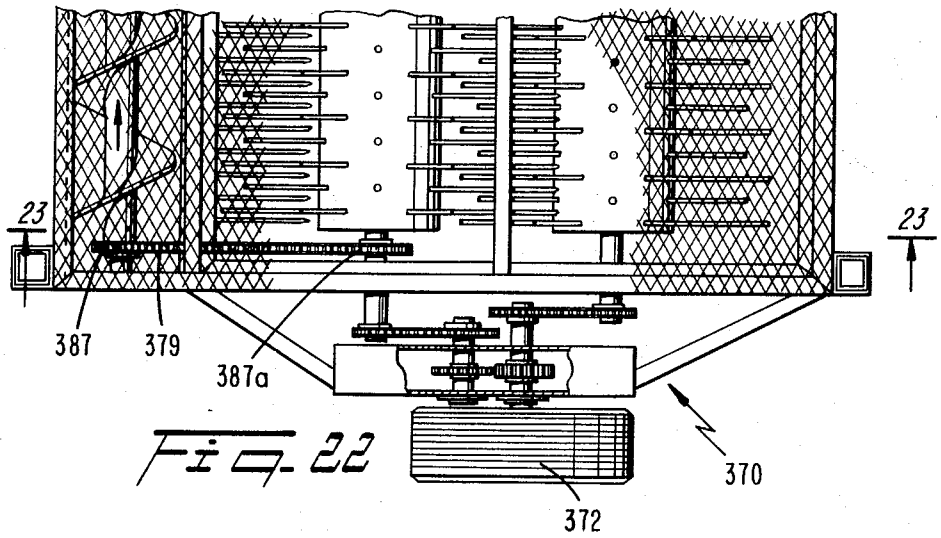
FIG. 22 is an enlarged, partial top view of the roller assembly and auger conveyor and means for driving same.

Reference is now made to FIGS. 16–23, wherein a third embodiment of the present invention is illustrated. A litter collecting apparatus 300, in accordance with the third embodiment, includes a main rigid frame 310 of generally rectangular, boxlike construction fabricated from a number of steel members welded or otherwise secured together. Main frame 310 can be attached to and supported by a rear panel door 311 of a dump truck 311*a* in elevational position above the ground surface (FIGS. 18 and 21). A litter pickup carriage 320, pivotally mounted for horizontal ground engaging positioning laterally adjacent the travel path of the dump truck, includes roller assembly 320' (corresponding to assembly 20' in the first embodiment, supra) to pick up surface litter. An auger conveyor 330 is mounted on the carriage downstream from roller assembly 320' to convey litter laterally towards main frame 310. A belt conveyor 340 is inclined upwardly in the forward direction on frame 310 to convey litter discharged from auger 330 into the dump truck.

Main frame 310, as best illustrated in FIGS. 16 and 18, includes four of vertical corner posts 312 defining the overall main frame shape. The posts 312 are rigidly interconnected with upper and lower horizontal, transverse frame members 314 and longitudinal frame members 316. A pair of mounting hooks 318 project upwardly from forward posts 312 respectively to engage upper edges of door 311 to support frame 310 in elevated position for travel over the ground. Extensible chock legs 319 project downwardly from lower ends of posts 312 to releasably connect frame 310 to the truck.

Belt conveyor 340 includes a pair of parallel, rigid side frames 342 having forward and rear ends attached respectively to upper and lower transverse frame members 314. A pair of idler rollers (not shown in detail) extend transversely between frames 342 at upstream and downstream ends thereof to support an endless conveyor belt 346, defining an upwardly inclined conveyor path. The rollers are mounted on shafts 348 rotatably supported by side frames 342.

Figure 19:
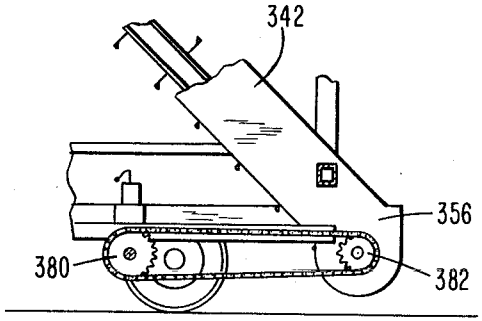
FIG. 19 is an enlarged, partial sectional view taken along the line 19—19 of FIG. 18 illustrating a mechanism connected to drive the main frame conveyor.

As best illustrated in FIGS. 18 and 21, the upstream end of conveyor 340 projects rearwardly and below main frame 310 into a stationary hopper 350. Hopper 350 includes a transversely extending curved plate 352 attached to a lower, rear transverse member 314, to define a trough 354 closed at its inner end by an end wall 356. As illustrated in FIG. 19, end wall 356 is preferably formed from a lower extension of left side frame 342. Trough 354 extends transversely below the upstream end of conveyor 340 to project outwardly from the main frame to a point immediately adjacent the discharge end of auger conveyor 330 to thereby transfer litter collected by roller assembly 320' to the main frame conveyor.

Rows of fingers 358, identical to fingers 140 in the first embodiment of the invention, described supra, are provided on belt 346 in uniform spaced relation. Fingers 358 project into trough 354 to transfer litter to the upper run of conveyor 340. The downstream end of conveyor 340 projects forwardly and above main frame 310 to discharge litter into the dump truck (FIG. 21).

Litter pickup carriage 320 includes a rectangular frame comprising a pair of parallel, horizontal frame members 322. The members 322 are laterally spaced from each other and connected at opposite ends with transverse frame members 324. A transverse member **324*a* is intermediately positioned upstream from and adjacent rear transverse member 324. A curved plate 325 attached to member 324*a* and rear member 324 extends transversely therebetween the full width of the carriage to define a trough 326 in alignment with trough 352. Auger conveyor 330 extends between members 324, 324*a* and cooperates with trough 326 to push litter into hopper 350**, as described more fully below.

To pivotally interconnect carriage 320 to main frame 310, a pair of clevises 332 are secured at opposite ends of member 322 located adjacent the main frame. A pair of attachment ears **332*a* secured to main frame member 316 are interpositioned within clevises 332 respectively, enabling a pivot shaft 328 to pass through aligned holes thereof, defining a horizontal, longitudinally extending pivot axis. As shown in FIG. 17, a winch 329*a* and guide roller 329*b* secured atop main frame 310 operate to pivot carriage 320 between a horizontal ground engaging position and a vertical, storage position about the pivot shaft axis via cable 329*c***.

Roller assembly 320' comprises identical front and rear rotating, tandem rollers 360 and 360' extending transversely between members 322. Rollers 360, 360' are identical in construction and operation to rollers 65, 65' described in the first embodiment of the invention. Each roller 360, 360' includes a pair of shaft ends 362 projecting outwardly from end walls thereof. Shafts 362 are rotatably secured to members 322 with pillow bearings 364.

As illustrated in FIG. 18, a cage 365 extends upwardly from attachment to carriage frame 320' to cover the upper portions of rollers 360, 360'. Cage 365 is substantially identical in construction and operation to cage 100, described in the first embodiment. A wiper rack 367 is mounted within cage 365 in elevated position to remove litter remaining entrapped between front roller fingers **360*a* after they disengage from rear roller fingers 360*b*. Wiper rack 367 is also identical in construction and operation to wiper rack 110**, described supra.

Figure 23:
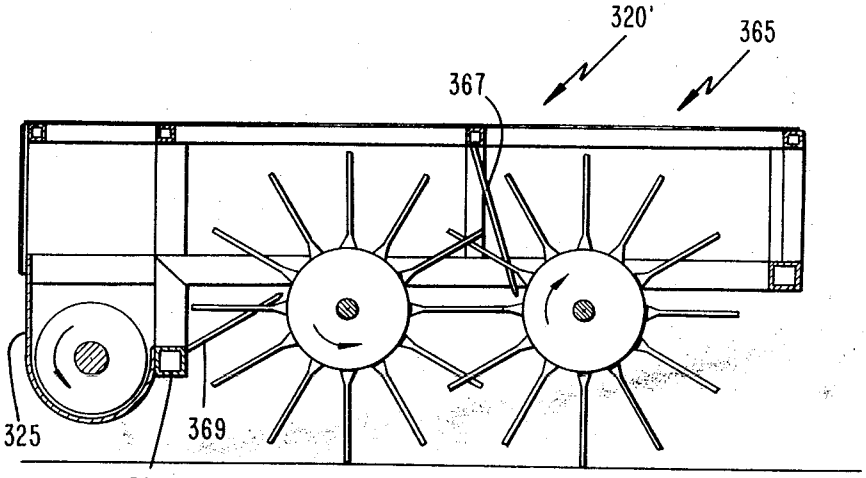
FIG. 23 is an enlarged sectional view taken along the line 23—23 of FIG. 22 to illustrate the pick up roller assembly in position on the ground to discharge litter to the auger conveyor.

To transfer litter from rear rollers 360' to auger conveyor 330, a second wiper rack 369 projects forwardly from intermediate transverse member **324*a*, as illustrated in FIGS. 18 and 23. Wiper rack 369 is identical in construction and operation to downstream rack blade 115** described in the first embodiment.

A gearbox, generally designated with reference numeral 370, includes a sprocket gear arrangement operated by a ground engaging drive wheel 372 to rotate pickup rollers 360, 360' clockwise and counterclockwise, respectively. Gearbox 370 is attached in outwardly adjacent location to outer carriage frame member 322 and corresponds in construction and operation to gearbox 66 described in the first embodiment. Wheel 372, in addition to rotating rollers 360, 360' during forward movement of truck **311*a*, also supports the outer end of carriage 320** in horizontal position above the ground.

As illustrated in FIG. 18, an inwardly projecting end of front roller shaft 362 provides driving connection to belt conveyor 340 via a driven shaft 377 on the main frame. A swivel joint 379 joins connecting ends of shaft 362, 377 in a vertical plane containing pivot shaft 328 intermediate the carriage and main frame, enabling the driving shaft to pivot with the carriage in the manner described above, without requiring detachment from driven shaft 377 when raised to the vertical position.

Driven shaft 377 extends transversely in substantial alignment with shaft 362 and is rotatably supported on the main frame with a pair of pillow bearings **378*a* secured to parallel, laterally spaced frame members 378 (see FIG. 16). A sprocket gear 380 is keyed to driven shaft 377 in longitudinal alignment with a sprocket gear 382 provided upon the shaft 348 carrying downstream roller 344. A single, endless chain 384 wrapped around gears 380, 382 is thus able to rotate downstream roller 344 clockwise due to rotation of shafts 362, 377 caused by wheel 372 to drive conveyor belt 346**.

While shafts 362, 377 are basically aligned with each other when carriage 320 is in ground engaging position. The use and aforesaid positioning of swivel joint 379 advantageously permits some degree of misalignment therebetween while continuing to transmit rotation to the drive shaft, as likely to occur under rugged terrain conditions.

As mentioned above, auger conveyor 330 is positioned within trough 326 to laterally convey litter picked up by roller assembly 320' into hopper 350. To mount auger 330, its outer end is rotatably supported within an end wall 383 attached to curved plate 325, as best illustrated in FIG. 17. A sprocket gear 387 keyed to the outer end of auger 330 is driven by a sprocket gear 387*a* keyed to rear roller shaft 362 via endless single chain 389 to transmit rotation to the auger from drive wheel 372 (see FIG. 22).

To support the inner end of auger conveyor 330 within trough 326, support bar 390 projects downwardly from inner frame member 322 and includes a bearing 392 rotatably securing the auger to the bar, as best illustrated in FIG. 20. Trough 326 is slightly spaced from mouth 394 of hopper 350, as shown in FIG. 18, to provide a smooth, uninterrupted transfer path towards belt conveyor 340. The innermost end of auger conveyor 330 projects slightly into mouth 394 to assure complete transfer of litter from carriage 320 into the hopper. Additionally, the innermost end of conveyor 330 is spaced sufficiently above trough 352 so as to be able to pivot downwardly out of the hopper mouth without striking the hopper when carriage 320 pivots into vertical position In operation, main frame 310 is initially elevated for attachment to truck 311*a* by extending chocks 319 with suitable hydraulic or mechanical means so that mounting hooks 318 can engage door 311 to support the main frame above the ground. Chocks 319 are then retracted. Winch 329*a* is then actuated to pivot carriage 320 downwardly into horizontal, ground engaging position about pivot shaft 328. Rollers 360, 360' are now positioned to pick up surface litter from a travel path located parallel and adjacent the truck path (e.g., a high shoulder) for discharge into the truck via movement through auger conveyor 330, hopper 350 and main frame conveyor 340.

The foregoing description of a preferred embodiment of the present invention has been presented for purposes of illustration and description. It is not intended to be exhaustive or to limit the invention to the precise form disclosed, and obviously, many modifications and variations are possible in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. Apparatus for collecting ground litter, comprising:

(a) a main frame including wheels supporting the frame for movement over the ground;

(b) front and rear rollers, and means for pivotally mounting the rollers to the main frame, each roller being driven in opposite direction to each other and respectively including plurality of fingers projecting outwardly therefrom a sufficient distance to contact the ground and lift objects engaged between adjacent fingers from the ground, said fingers on the front roller rotating upwardly into meshing contact with said fingers on the rear roller so that objects engaged between fingers of the front fingers by the rear fingers and entrapped between the rear fingers for transfer thereto;

(c) wiper means meshing with the front and rear roller fingers for dislodging objects entrapped between the fingers and to augment transfer of said objects towards said rear roller fingers, said wiper means including means located to engage with the front fingers as the front fingers travel out of contact with the rear fingers to dislodge objects entrapped between the front fingers as the front fingers travel towards their uppermost position, said means being further located to direct said dislodged object onto the rear fingers;

(d) means on the main frame for storing objects lifted by the front and rear rollers; and (e) means for conveying said objects from the rear roller to the storage means.

2. The apparatus of claim 1, further including a carriage pivotally secured to the main frame, said carriage rotatably supporting said front and rear rollers in longitudinal alignment with each other.

3. The apparatus of claim 2, wherein said front and rear rollers are identical to each other, and extend transversely along a full width of the carriage, said front and rear roller fingers being resilient and arranged in circumferentially spaced rows throughout substantially the entire outer surface of each roller.

4. The apparatus of claim 3, further including means for rotating said front and rear rollers in opposite directions.

5. The apparatus of claim 4, wherein said rotating means includes a drive wheel engageable with the ground and sprocket gear means driven by the drive wheel and connected to drive the front and rear rollers.

6. The apparatus of claim 4, further including protective cage means having a top cover and side covers attached to said carriage, said top cover and side covers enclosing an upper portion of each roller and the wiper means to retain litter picked up by said roller fingers within a transfer path defined by said upper portion of each roller and the wiper means.

7. The apparatus of claim 6, wherein said top cover is spaced apart from the front and rear roller fingers.

8. The apparatus of claim 6, wherein said wiper means is a wiper blade means includes an upstream blade mounted above said cage means, said wiper blade including a plurality of tines projecting downwardly and forwardly to mesh with and wipe the front roller fingers, said tines defining an acute angle with the meshing front roller fingers to dislodge litter from said fingers.

9. The apparatus of claim 8, further including a second wiper blade downstream from the rear roller, said second wiper blade including a plurality of tines projecting forwardly to mesh with and dislodge objects from the rear roller fingers for transfer to the conveying means.

10. The apparatus of claim 9, wherein said conveying means includes sideframe members to rotatably support a pair of idler rollers at upstream and downstream ends of the conveyer, said conveying means carrying an endless conveyor belt having an upstream end positioned below the second wiper means to receive litter therefrom, said gear means being connected to one of said conveyor rollers to drive the conveyor.

11. The apparatus of claim 10, wherein said conveyor belt includes spaced rows of fingers projecting upwardly from the belt, said fingers operable to engage litter discharged by the rear roller for transfer to said storage means.

12. The apparatus of claim 11, said conveying means further including a conveyor housing comprising side panel members attached to said support members and a bottom panel member extending along the entire length of a lower run of the conveyor belt, said bottom member defining a trough at the upstream end positioned below the second wiper blade to collect any litter failing to engage said conveyor fingers, said fingers being operable to move through the trough and redeposit litter for transfer to the storage means along an upper run of said conveyor belt.

13. The apparatus of claim 12, wherein said storage means includes a trash drum pivotally secured to the main frame by a connecting means, said connecting means having a pair of connecting arms interconnecting the drum to a pivot shaft, said pivot shaft extending transversely and being rotatably secured to an upper main frame support member to pivot the drum from a lower, trash collecting position to an elevated, trash dumping position.

14. The apparatus of claim 13, further including motor means and sprocket gearing means connected to the motor means to drive the pivot shaft to pivot the drum between said lower and elevated positions.

15. The apparatus of claim 13, wherein said trash drum includes an opening communicating with the downstream, discharge end of the conveyor means when the drum is in the lower position, said drum further including an abutment plate engaging the conveyor bottom panel to align said opening with the conveyor downstream end.

16. The apparatus of claim 2, wherein said main frame includes a pair of parallel, lateraly-spaced side truss members supporting said carriage and conveyor means on the main frame.

17. Apparatus for collecting surface litter and the like on the ground, comprising:

(a) a main frame having means for supporting the frame in elevated position on a vehicle;

(b) a carriage pivotally attached to the main frame for movement between a vertical, storage position and a horizontal, ground engaging position laterally adjacent said frame;

(c) front and rear tandem rollers mounted on said carriage, each roller being driven in opposite direction to each other and respectively including a pluraliy of fingers projecting outwardly therefrom and being engageable with the ground to grasp and remove surface litter engaged between adjacent fingers from the ground, said front and rear fingers being timed to mesh between the rollers to transfer substantially entirely all litter entrapped by the front fingers rotating upwardly into meshing contact with and to the rear fingers so that objects engaged between fingers of the front roller have a tendency to become dislodged from the front fingers by the rear fingers and entrapped between the rear fingers for transfer thereto, causing litter to move downstream over the rear roller; and wiper blade means meshing with the front and rear roller fingers to dislodge objects entrapped between the fingers to augment transfer of said objects towards said rear roller fingers;

(d) auger conveyor means positioned downstream the rear roller and mounted on the carriage for conveying litter transferred downstream of by the rear fingers laterally towards the main frame; and (e) means mounted on the main frame for conveying litter transferred from said auger means into a collection area of the vehicle.

18. The apparatus of claim 17, further including means for pivotally connecting the main frame and carriage, said connecting means having a longitudinally extending, substantially horizontal pivot shaft defining a pivot axis located between the carriage and main frame, enabling the carriage to pivot laterally between the horizontal and vertical positions.

19. The apparatus of claim 18, further including means for simultaneously rotating said front and rear rollers in opposite directions and to rotate said auger means, said rotating means including a drive wheel mounted on the carriage and engageable with the ground and sprocket gear means driven by the drive wheel and connected to drive the rollers and auger conveyor.

20. The apparatus of claim 19, including additional sprocket gear means and a shaft, both mounted on the main frame and connected to drive the main frame conveyor means, and means for connecting said shaft carrying said roller respectively, said connecting means being a swivel joint located in the same vertical plane as the pivot shaft, said joint effective to transmit rotation from one of the roller shafts to the main frame shaft when the carriage is in the horizontal position and enabling the roller shaft to pivot with respect to the main frame shaft about the swivel joint into vertical position without requiring detachment.

21. The apparatus of claim 20, wherein said auger means is mounted for rotation within a trough attached to the carriage, and further including a hopper mounted on the main frame in alignment with the trough to transfer litter recieved from the trough to the main frame conveyor, said auger projecting into a mouth of the hopper a predetermined distance to completely transfer litter thereto, said predetermined distance allowing the auger to pivot out of the mouth without striking the hopper when said carriage pivots into vertical position.

22. Apparatus for collecting litter lying on the ground, comprising:

(a) a main frame including means supporting the main frame for movement over the ground;

(b) a front roller and means for pivotally mounting the front roller to the main frame, said roller including a plurality of fingers projecting outwardly therefrom to contact the ground to grasp and lift objects therefrom;

(c) means rotatably mounted downstream from the front roller, said means including a plurality of fingers projecting outwardly therefrom to grasp and remove objects from the ground, said front roller and rotatable downstream means being driven in opposite direction to each other with said fingers on the front roller rotating upwardly into meshing contact with said fingers on said rotatable downstream means so that objects engaged between fingers on the front roller have a tendency to become dislodged from the front fingers by the rear fingers and entrapped between the rear fingers for transfer thereto;

(d) wiper means meshing with the front and rear fingers for dislodging objects entrapped between the front and rear fingers and to augment transfer of said objects towards said rear fingers, said wiper means including means located to engage with the front fingers as the front fingers travel out to contact with the rear fingers to dislodge objects entrapped between the front fingers as the front fingers travel towards their uppermost position, said means being further located to direct said dislodged objects onto the rear fingers; and (e) storage means on the main frame for storing objects lifted by the front and rear fingers, said fingers on the rotatable downstream means conveying said objects in the direction of said storage means, and means for directing said objects from the fingers into the storage means.

23. The apparatus of claim 22, further including height adjustment means to vary the height of the roller fingers relative to the ground.

24. The apparatus of claim 22, wherein said wiper means includes a wiper rack meshing with the front fingers, said rack extending upward in the downstream direction with respect to the front fingers said front fingers at their initial point of contact with the wiper rack establishing a predetermined acute angle with the wiper rack.

25. The apparatus of claim 24, wherein said wiper rack is arranged so that free ends of said rear fingers pass in close proximity to and below the wiper rack as said rear fingers travel out of contact with the front fingers.

26. Apparatus for collecting litter lying on the ground, comprising:

(a) a main frame including means supporting the main frame for movement over the ground;

(b) a front roller, and means for movably mounting the front roller to the main frame, said roller including a plurality of fingers projecting outwardly therefrom to contact the ground to grasp and lift objects therefrom;

(c) means rotatably mounted downstream from the front roller, said means including a plurality of fingers projecting outwardly therefrom to grasp and remove objects from the ground, said front roller and rotatable downstream means being driven in opposite direction to each other with said fingers on the front roller rotating upwardly into meshing contact with said fingers on said rotatable downstream means so that objects engaged between fingers of the front roller have a tendency to become dislodged from the front fingers by the rear fingers and entrapped between the rear fingers for transfer thereto;

(d) cleaning means cooperating with the front and rear fingers and directed between adjacent fingers for dislodging objects entrapped between the front and rear fingers and to augment transfer of said object towards said rear fingers, said cleaning means including means located to enter between adjacent front fingers as they travel out of contact with the rear fingers to dislodge objects entrapped between the front fingers as the front fingers travel towards their uppermost position, said means being further located to direct said dislodged objects onto the rear fingers; and (e) storage means on the main frame for storing objects lifted by the front and rear fingers, said fingers on the rotatable downstream means conveying said objects in the direction of said storage means, and means for directing the object from the fingers into the storage means.

27. Apparatus for collecting litter lying on the ground, comprising:

(a) a main frame including means supporting the main frame for movement over the ground;

(b) a carriage pivotally secured to the main frame;

(c) a front roller rotatably connected to the carriage, said roller including a plurality of fingers projecting outward therefrom to contact the ground to grasp and lift objects therefrom;

(d) means rotatably mounted on the pivotal carriage downstream from the front roller, said means including a plurality of fingers projecting outward therefrom to grasp and remove objects from the ground, said front roller and rotatable downstream means being driven in opposite directions to each other with said fingers on the front roller rotating upward into meshing contact with said fingers on said rotatably downstream means so that objects engaged between fingers of the front roller have a tendency to become dislodged from the front fingers by the rear fingers and entrapped between the rear fingers for transfer thereto, said pivotal carriage being movable between a raised position wherein the front and rear fingers are out of contact with the ground and a lower operative position wherein said front and rear fingers engage the ground;

(e) wiper means meshing with the front and rear fingers for dislodging objects entrapped between the front and rear fingers and to augment transfer of said objects towards said rear fingers; and (f) storage means on the main frame for storing objects lifted by the front and rear fingers, said fingers o the rotatable downstream means conveying said objects in the direction of said storage means, and means for directing the objects from the fingers into the storage means.

28. Apparatus for collecting litter lying on the ground, comprising:

(a) a main frame including means supporting the main frame for movement over the ground;

(b) a carriage pivotally secured to the main frame;

(c) a front roller rotatably connected to the main frame, said roller including a plurality of fingers projecting outward therefrom to contact the ground to grasp and lift objects therefrom;

(d) means rotatably mounted on the pivotal carriage downstream from the front roller, said means including a plurality of fingers projecting outward therefrom to grasp and remove objects from the ground, said front roller and rotatably downstream means being driven in opposite directions to each other with said fingers on the front roller rotating upwardly into meshing contact with said fingers on said rotatable downstream means that objects engaged between fingers of the front roller have a tendency to become dislodged from the front fingers by the rear fingers and entrapped between the rear fingers for transfer thereto, said carriage being movable between a raised, in operative position wherein the front and rear fingers are out of contact with the ground and a lowered operative position wherein said front and rear fingers contact the ground;

(e) means cooperating with the front and rear fingers and directed between adjacent fingers for dislodging objects entrapped between the front and rear fingers and to augment transfer of said objects towards said rear fingers; and (f) storage means on the main frame for storing objects lifted by the front and rear fingers, said fingers on the rotatable downstream means conveying said objects in the direction of said storage means, and means for directing the object from the fingers into the storage means.

* * * * *